US008899437B2

(12) United States Patent
Vogel et al.

(10) Patent No.: US 8,899,437 B2
(45) Date of Patent: Dec. 2, 2014

(54) CLOSURE WITH INTEGRATED DOSAGE CUP

(71) Applicant: Gateway Plastics, Inc., Mequon, WI (US)

(72) Inventors: William C. Vogel, Mequon, WI (US); Terrence M. Parve, Menomonee Falls, WI (US); Michael Walker, Kalamazoo, MI (US)

(73) Assignee: Gateway Plastics, Inc., Mequon, WI (US)

( * ) Notice: Subject to any disclaimer, the term of this patent is extended or adjusted under 35 U.S.C. 154(b) by 0 days.

(21) Appl. No.: 13/741,992

(22) Filed: Jan. 15, 2013

(65) Prior Publication Data

US 2013/0193143 A1 Aug. 1, 2013

Related U.S. Application Data

(60) Provisional application No. 61/589,156, filed on Jan. 20, 2012.

(51) Int. Cl.
*B65D 41/56* (2006.01)
*B65D 51/24* (2006.01)

(52) U.S. Cl.
CPC ..... *B65D 51/248* (2013.01); *B65D 41/56* (2013.01)
USPC ..... 220/212; 220/266; 220/281; 220/288; 220/377; 215/228; 215/230

(58) Field of Classification Search
CPC ..... B65D 51/248; B65D 41/56
USPC ..... 220/212, 281, 266, 288, 377; 215/228, 215/230
See application file for complete search history.

(56) References Cited

U.S. PATENT DOCUMENTS

| | | | | |
|---|---|---|---|---|
| 202,268 | A | 4/1878 | Keller | |
| 847,726 | A | 10/1906 | Brannon | |
| 1,780,875 | A | 11/1930 | Gordon | |
| 1,820,817 | A | 8/1931 | McRae | |
| 1,869,712 | A | 8/1932 | Palmer | |
| 2,102,440 | A | 12/1937 | Sebell | |
| 2,108,063 | A | 2/1938 | Hothersall | |
| 2,108,692 | A * | 2/1938 | Pieck | 141/381 |
| D120,154 | S | 4/1940 | Carson | |

(Continued)

FOREIGN PATENT DOCUMENTS

| | | |
|---|---|---|
| CA | 1245601 | 11/1988 |
| CH | 491014 | 7/1970 |

(Continued)

OTHER PUBLICATIONS

U.S. Appl. No. 29/416,677, filed Mar. 26, 2012, Vogel et al.

*Primary Examiner* — Elizabeth Volz
(74) *Attorney, Agent, or Firm* — Foley & Lardner LLP

(57) ABSTRACT

A child resistant closure is provided that is configured to fit over the opening of a receptacle to form a container. The closure includes an inner dosage cup and an outer cap portion that receives and retains the inner dosage cup. The outer cap portion is rotatable relative to the inner dosage cup and defines at least one viewing window that allows for visual indication of a level of contents within the inner dosage cup.

20 Claims, 9 Drawing Sheets

(56) References Cited

U.S. PATENT DOCUMENTS

| | | | |
|---|---|---|---|
| D120,155 | S | 4/1940 | Carson |
| D136,002 | S | 7/1943 | Mas |
| 2,687,157 | A | 8/1954 | Cowan |
| 2,762,526 | A | 9/1956 | Gilmour |
| 2,778,533 | A | 1/1957 | Savary |
| 2,826,343 | A | 3/1958 | Albiani |
| 2,894,654 | A | 7/1959 | Lohrer |
| 3,013,308 | A | 12/1961 | Armour |
| 3,018,931 | A | 1/1962 | Westgate |
| 3,033,407 | A | 5/1962 | Isele-Aregger |
| D193,121 | S | 6/1962 | Wickman |
| 3,059,816 | A | 10/1962 | Goldstein |
| 3,110,410 | A | 11/1963 | Pehr |
| 3,115,994 | A | 12/1963 | Grady |
| 3,117,701 | A | 1/1964 | Stull |
| 3,131,824 | A | 5/1964 | Van Baarn |
| 3,135,456 | A | 6/1964 | Palazzolo |
| 3,143,256 | A | 8/1964 | Lazure et al. |
| 3,155,285 | A | 11/1964 | Van Baam |
| D200,270 | S | 2/1965 | Waterman |
| 3,180,537 | A | 4/1965 | Collins |
| 3,181,746 | A | 5/1965 | Tupper |
| D204,509 | S | 4/1966 | Waterman |
| 3,262,606 | A | 7/1966 | Waterman |
| 3,322,308 | A | 5/1967 | Foster |
| 3,323,671 | A | 6/1967 | Minarik et al. |
| 3,351,242 | A | 11/1967 | Lodding et al. |
| 3,412,890 | A | 11/1968 | Rich |
| 3,499,588 | A | 3/1970 | Bartilson et al. |
| 3,542,235 | A | 11/1970 | Hidding |
| 3,563,426 | A | 2/1971 | Bartilson |
| 3,629,901 | A | 12/1971 | Wolf |
| 3,651,992 | A | 3/1972 | Hazard |
| 3,675,812 | A | 7/1972 | Foster |
| 3,782,583 | A | 1/1974 | Abbey |
| 3,851,812 | A | 12/1974 | Bittel |
| 3,860,135 | A | 1/1975 | Yung et al. |
| 3,881,639 | A | 5/1975 | Herip |
| 3,907,156 | A | 9/1975 | Weatherhead, III |
| 3,912,128 | A | 10/1975 | Ziemann et al. |
| 3,933,271 | A | 1/1976 | McGhie |
| 3,948,415 | A | 4/1976 | Debenham |
| 3,966,080 | A | 6/1976 | Bittel |
| 3,998,354 | A | 12/1976 | Song |
| 4,022,352 | A | 5/1977 | Pehr |
| 4,029,202 | A | 6/1977 | Lasich et al. |
| 4,040,595 | A | 8/1977 | Tecco |
| 4,082,201 | A | 4/1978 | Bittel |
| 4,106,672 | A | 8/1978 | Tecco et al. |
| 4,127,221 | A | 11/1978 | Vere |
| 4,135,404 | A | 1/1979 | Butler, Jr. |
| 4,163,496 | A | 8/1979 | Dogliotti |
| 4,170,315 | A | 10/1979 | Dubach et al. |
| 4,177,932 | A | 12/1979 | Cleevely |
| 4,183,457 | A | 1/1980 | Loughley et al. |
| 4,223,814 | A | 9/1980 | Sneider |
| 4,236,653 | A | 12/1980 | Gach |
| D258,052 | S | 1/1981 | Firanzi |
| 4,253,587 | A | 3/1981 | Otterson |
| D258,869 | S | 4/1981 | Firanzi |
| 4,270,664 | A | 6/1981 | Buono |
| 4,274,563 | A | 6/1981 | Otterson |
| 4,280,636 | A | 7/1981 | Lewis |
| 4,284,200 | A | 8/1981 | Bush et al. |
| 4,291,818 | A | 9/1981 | Nozawa et al. |
| 4,308,979 | A | 1/1982 | Otterson |
| 4,318,500 | A | 3/1982 | Melikian |
| 4,326,649 | A | 4/1982 | Marino et al. |
| D265,060 | S | 6/1982 | Blank |
| 4,334,639 | A | 6/1982 | Gach |
| D266,390 | S | 10/1982 | Haner |
| 4,359,171 | A | 11/1982 | Lewis |
| 4,361,250 | A | 11/1982 | Foster |
| 4,369,901 | A | 1/1983 | Hidding |
| D268,482 | S | 4/1983 | Mineo |
| 4,380,307 | A | 4/1983 | Stillinger |
| 4,403,712 | A | 9/1983 | Wiesinger |
| 4,414,705 | A | 11/1983 | Ostrowsky |
| D272,807 | S | 2/1984 | Ruhl |
| 4,457,458 | A | 7/1984 | Heinol |
| 4,489,864 | A | 12/1984 | Davis |
| D276,981 | S | 1/1985 | Cleevely |
| D277,458 | S | 2/1985 | Neggers |
| 4,503,991 | A | 3/1985 | Joyce |
| D278,602 | S | 4/1985 | Rosenstein |
| 4,533,058 | A | 8/1985 | Uhlig |
| 4,538,731 | A | 9/1985 | Cillario |
| 4,541,541 | A | 9/1985 | Hickman et al. |
| 4,545,495 | A | 10/1985 | Kinsley |
| 4,545,508 | A | 10/1985 | Cribb et al. |
| 4,550,862 | A | 11/1985 | Barker et al. |
| 4,566,508 | A | 1/1986 | Bowyer |
| 4,566,509 | A | 1/1986 | Szajna |
| 4,573,600 | A | 3/1986 | Dubach |
| 4,610,371 | A | 9/1986 | Karkiewicz |
| 4,629,081 | A | 12/1986 | McLaren |
| 4,648,528 | A | 3/1987 | LaBarge et al. |
| 4,658,980 | A | 4/1987 | Lindstrom |
| 4,660,746 | A | 4/1987 | Wright |
| D291,411 | S | 8/1987 | Crawford |
| 4,693,399 | A | 9/1987 | Hickman et al. |
| D292,882 | S | 11/1987 | Gross |
| 4,714,181 | A | 12/1987 | Kozlowski et al. |
| 4,718,567 | A | 1/1988 | La Vange |
| 4,723,693 | A | 2/1988 | DeCoster |
| 4,724,977 | A | 2/1988 | Cleevely et al. |
| 4,726,091 | A | 2/1988 | Joyce |
| 4,730,731 | A | 3/1988 | Allison |
| 4,733,794 | A | 3/1988 | Kent |
| 4,735,334 | A | 4/1988 | Abbott |
| 4,735,335 | A | 4/1988 | Torterotot |
| 4,739,906 | A | 4/1988 | LoTurco |
| D296,081 | S | 6/1988 | Kuboshima |
| 4,778,071 | A | 10/1988 | Fillmore |
| 4,792,054 | A | 12/1988 | Weidman |
| 4,793,501 | A | 12/1988 | Beck |
| 4,793,502 | A | 12/1988 | Beck |
| 4,802,597 | A | 2/1989 | Dubach |
| 4,813,560 | A | 3/1989 | Begley |
| 4,823,995 | A | 4/1989 | Lewis |
| 4,838,441 | A | 6/1989 | Chernack |
| 4,844,302 | A | 7/1989 | Lay |
| 4,848,612 | A | 7/1989 | Beck |
| 4,854,473 | A | 8/1989 | Dubach |
| 4,881,668 | A | 11/1989 | Kitterman et al. |
| D305,206 | S | 12/1989 | Hickman et al. |
| 4,890,770 | A | 1/1990 | Haga et al. |
| 4,898,292 | A | 2/1990 | VerWeyst et al. |
| D306,701 | S | 3/1990 | Beck |
| 4,915,268 | A | 4/1990 | Lay et al. |
| 4,919,286 | A | 4/1990 | Agbay, Sr. |
| 4,936,494 | A | 6/1990 | Weidman |
| 4,940,167 | A | 7/1990 | Fillmore et al. |
| 4,955,513 | A | 9/1990 | Bennett |
| 4,984,716 | A | 1/1991 | Beck |
| 4,993,606 | A | 2/1991 | Bolen et al. |
| D315,307 | S | 3/1991 | Kanyer |
| 5,007,555 | A | 4/1991 | Beck |
| 5,020,686 | A | 6/1991 | Dutt |
| D318,778 | S | 8/1991 | Fiore et al. |
| 5,042,658 | A | 8/1991 | Tiramani et al. |
| 5,048,730 | A | 9/1991 | Forsyth et al. |
| D320,746 | S | 10/1991 | Bolen et al. |
| D321,137 | S | 10/1991 | Hofmann et al. |
| 5,067,624 | A | 11/1991 | Thanisch |
| 5,078,289 | A | 1/1992 | Bolton et al. |
| 5,083,671 | A | 1/1992 | Hayes |
| 5,085,331 | A | 2/1992 | Groya et al. |
| 5,115,929 | A | 5/1992 | Buono |
| 5,115,931 | A | 5/1992 | Dubach |
| 5,139,165 | A | 8/1992 | Hara |
| 5,143,234 | A | 9/1992 | Lohrman et al. |
| D331,877 | S | 12/1992 | Robichaud et al. |
| D331,878 | S | 12/1992 | Forsyth |

(56) References Cited

U.S. PATENT DOCUMENTS

| | | | |
|---|---|---|---|
| 5,167,338 | A | 12/1992 | Kick |
| 5,181,630 | A | 1/1993 | McNally |
| D333,617 | S | 3/1993 | Brown |
| 5,193,704 | A | 3/1993 | Kick |
| 5,197,616 | A | 3/1993 | Buono |
| 5,211,301 | A | 5/1993 | Groya et al. |
| 5,219,100 | A | 6/1993 | Beck et al. |
| 5,228,596 | A | 7/1993 | McNally |
| D339,065 | S | 9/1993 | Forsyth et al. |
| D340,187 | S | 10/1993 | Forsyth |
| D340,188 | S | 10/1993 | Forsyth |
| 5,249,695 | A | 10/1993 | Luch et al. |
| 5,261,569 | A | 11/1993 | Sandwell |
| 5,271,519 | A | 12/1993 | Adams et al. |
| 5,305,931 | A | 4/1994 | Martin et al. |
| D346,958 | S | 5/1994 | Olson |
| D347,974 | S | 6/1994 | McBride |
| 5,330,082 | A | 7/1994 | Forsyth |
| 5,339,993 | A | 8/1994 | Groya et al. |
| 5,348,183 | A | 9/1994 | Luch et al. |
| 5,356,017 | A | 10/1994 | Rohr et al. |
| 5,370,251 | A | 12/1994 | Buono |
| 5,377,882 | A | 1/1995 | Pham et al. |
| 5,383,582 | A | 1/1995 | Baxter et al. |
| D355,121 | S | 2/1995 | Kohl |
| 5,386,918 | A | 2/1995 | Neveras et al. |
| 5,397,013 | A | 3/1995 | Adams et al. |
| 5,423,442 | A | 6/1995 | Nozawa et al. |
| 5,435,456 | A | 7/1995 | Dubach |
| D361,512 | S | 8/1995 | Dalmaz |
| 5,464,110 | A | 11/1995 | Heyworth |
| 5,489,035 | A | 2/1996 | Fuchs |
| 5,499,736 | A | 3/1996 | Kohl |
| 5,501,348 | A | 3/1996 | Takeuchi |
| 5,509,582 | A | 4/1996 | Robbins, III |
| 5,513,780 | A | 5/1996 | Buono |
| 5,531,349 | A | 7/1996 | Wojcik et al. |
| 5,540,343 | A | 7/1996 | Schumacher |
| 5,542,579 | A | 8/1996 | Robbins, III |
| 5,549,224 | A | 8/1996 | Wu et al. |
| 5,558,239 | A | 9/1996 | Dubach |
| 5,566,850 | A | 10/1996 | Forsyth et al. |
| 5,579,934 | A | 12/1996 | Buono |
| 5,579,957 | A | 12/1996 | Gentile et al. |
| 5,588,546 | A | 12/1996 | Farside |
| 5,603,421 | A | 2/1997 | Opresco |
| 5,620,107 | A | 4/1997 | Takeuchi |
| 5,632,417 | A | 5/1997 | Robbins et al. |
| 5,642,824 | A | 7/1997 | Hess et al. |
| 5,667,089 | A | 9/1997 | Moore |
| 5,667,094 | A | 9/1997 | Rapchak et al. |
| 5,667,106 | A | 9/1997 | Robbins, III |
| D385,791 | S | 11/1997 | Forsyth et al. |
| 5,755,352 | A | 5/1998 | Wojcik et al. |
| 5,758,793 | A | 6/1998 | Forsyth et al. |
| 5,762,216 | A | 6/1998 | Takeuchi |
| 5,785,193 | A | 7/1998 | Kobayashi et al. |
| 5,794,803 | A | 8/1998 | Sprick |
| 5,799,838 | A | 9/1998 | Miller |
| 5,823,345 | A | 10/1998 | Nask et al. |
| D404,201 | S | 1/1999 | Wennerstrom |
| 5,865,330 | A | 2/1999 | Buono |
| 5,865,353 | A | 2/1999 | Baudin |
| 5,873,493 | A | 2/1999 | Robinson |
| 5,875,907 | A | 3/1999 | Lay |
| 5,881,894 | A | 3/1999 | Gargano |
| 5,908,125 | A | 6/1999 | Opresco |
| 5,913,435 | A | 6/1999 | Fuchs |
| D413,064 | S | 8/1999 | Bansal |
| D414,698 | S | 10/1999 | Mogard et al. |
| 5,971,231 | A | 10/1999 | Samz et al. |
| 5,975,368 | A | 11/1999 | Wood |
| 5,996,859 | A | 12/1999 | Beck |
| 6,036,036 | A | 3/2000 | Bilani et al. |
| 6,039,224 | A | 3/2000 | Dallas et al. |
| 6,041,477 | A | 3/2000 | Rentsch et al. |
| 6,102,257 | A | 8/2000 | Goyet |
| 6,116,469 | A | 9/2000 | Wallays et al. |
| 6,152,320 | A | 11/2000 | Hierzer et al. |
| 6,158,632 | A | 12/2000 | Ekkert |
| 6,164,503 | A | 12/2000 | Forsyth et al. |
| D436,040 | S | 1/2001 | Warner et al. |
| 6,223,946 | B1 | 5/2001 | Geisinger et al. |
| 6,250,507 | B1 | 6/2001 | Ekkert |
| 6,250,517 | B1 | 6/2001 | Samz et al. |
| 6,273,152 | B1 | 8/2001 | Buehler et al. |
| 6,276,572 | B1 | 8/2001 | Evans |
| 6,283,317 | B1 | 9/2001 | Benoit-Gonin et al. |
| 6,289,906 | B1 | 9/2001 | Vanden et al. |
| 6,299,033 | B1 | 10/2001 | VerWeyst et al. |
| 6,308,870 | B2 | 10/2001 | Samz et al. |
| 6,321,923 | B1 | 11/2001 | Wood |
| 6,332,551 | B1 | 12/2001 | Copeland |
| D453,892 | S | 2/2002 | Lindsay et al. |
| 6,343,723 | B1 | 2/2002 | Hickerson |
| RE37,634 | E | 4/2002 | Hickman et al. |
| 6,364,169 | B1 | 4/2002 | Knickerbocker |
| 6,371,316 | B1 | 4/2002 | Herr et al. |
| 6,382,476 | B1 | 5/2002 | Randall et al. |
| 6,405,885 | B1 | 6/2002 | Elliott |
| 6,439,410 | B1 | 8/2002 | Dubach |
| 6,460,712 | B2 | 10/2002 | Smith et al. |
| 6,460,718 | B1 | 10/2002 | Vogel |
| 6,460,726 | B1 | 10/2002 | Hierzer et al. |
| 6,464,113 | B1 | 10/2002 | Vogel |
| 6,488,187 | B2 | 12/2002 | Sheffler et al. |
| D468,639 | S | 1/2003 | Wennerstrom et al. |
| 6,510,971 | B1 | 1/2003 | Martin |
| D472,138 | S | 3/2003 | Brozell et al. |
| 6,543,649 | B1 | 4/2003 | Danielo et al. |
| 6,550,626 | B1 | 4/2003 | Randall |
| 6,575,323 | B1 | 6/2003 | Martin et al. |
| D476,563 | S | 7/2003 | Brozell et al. |
| D476,892 | S | 7/2003 | Martin et al. |
| D476,897 | S | 7/2003 | Brozell |
| 6,601,740 | B1 | 8/2003 | Clive |
| 6,612,450 | B1 | 9/2003 | Buono |
| 6,631,820 | B2 | 10/2003 | Harrold et al. |
| 6,644,487 | B2 | 11/2003 | Smith et al. |
| 6,648,188 | B2 | 11/2003 | Brecheisen et al. |
| 6,688,501 | B2 | 2/2004 | DeGroot et al. |
| 6,691,901 | B2 | 2/2004 | Parve et al. |
| 6,705,495 | B2 | 3/2004 | Brecheisen et al. |
| 6,761,279 | B1 | 7/2004 | Martin et al. |
| 6,766,926 | B1 | 7/2004 | Elchert |
| 6,786,363 | B1 | 9/2004 | Lohrman |
| 6,830,721 | B2 | 12/2004 | Martin |
| 6,880,736 | B1 | 4/2005 | Gnepper |
| 6,904,867 | B2 | 6/2005 | Zamjahn |
| 6,935,543 | B2 | 8/2005 | DeGroot et al. |
| D509,426 | S | 9/2005 | Samz et al. |
| 6,948,643 | B1 | 9/2005 | Lohrman |
| D513,983 | S | 1/2006 | Erdie |
| 7,032,632 | B2 | 4/2006 | Shingle |
| 7,097,071 | B2 | 8/2006 | Anderson et al. |
| 7,134,575 | B2 | 11/2006 | Vogel et al. |
| 7,147,020 | B2 | 12/2006 | Bronner |
| 7,168,461 | B2 | 1/2007 | DeJonge |
| 7,213,620 | B2 | 5/2007 | DeJonge |
| 7,296,700 | B2 | 11/2007 | Steele et al. |
| D562,132 | S | 2/2008 | LaMasney |
| 7,909,212 | B2 | 3/2011 | Parve |
| 2002/0079339 | A1 | 6/2002 | Sheffler et al. |
| 2003/0116879 | A1 | 6/2003 | Mueller et al. |
| 2004/0118881 | A1 | 6/2004 | Brecheisen et al. |
| 2004/0134942 | A1 | 7/2004 | Parve et al. |
| 2004/0169307 | A1 | 9/2004 | Mueller et al. |
| 2004/0226950 | A1 | 11/2004 | Samz et al. |
| 2005/0023304 | A1 | 2/2005 | Vogel et al. |
| 2006/0278665 | A1 | 12/2006 | Bennett |
| 2008/0017665 | A1 | 1/2008 | Brecheisen et al. |

(56) References Cited

U.S. PATENT DOCUMENTS

| | | | | |
|---|---|---|---|---|
| 2008/0142547 | A1 | 6/2008 | Colacioppo et al. | |
| 2009/0159544 | A1 | 6/2009 | Tune | |
| 2010/0126997 | A1* | 5/2010 | Stull et al. | 220/281 |
| 2011/0248048 | A1 | 10/2011 | Fernandez De Mendiola Quintana et al. | |
| 2012/0085791 | A1 | 4/2012 | Groubert et al. | |

FOREIGN PATENT DOCUMENTS

| | | |
|---|---|---|
| DE | 37 34 156 | 4/1988 |
| DE | 42 39 299 | 3/1994 |
| EP | 0 590 325 | 4/1994 |
| EP | 0 631 942 | 1/1995 |
| WO | WO-94/20713 | 9/1994 |

* cited by examiner

CLOSURE WITH INTEGRATED DOSAGE CUP

CROSS-REFERENCE TO RELATED APPLICATIONS

This application claims the benefit of priority to U.S. Provisional Patent Application No. 61/589,156, which was filed on Jan. 20, 2012, the complete disclosure of which is incorporated by reference herein.

BACKGROUND

The present disclosure relates to a closure for a container for storing and dispensing matter. The present disclosure more specifically relates to a child resistant closure for a container for storing and dispensing a liquid.

Medicines in the form of a liquid are usually contained within a container that is closed by a child resistant closure that functions to seal the container opening and prevent a child from inadvertently opening the container. To serve the liquid medicine, the liquid medicine must be poured into a separate dispensing device (e.g., a measuring cup, spoon, etc.). Further, the containers typically carry a label that provides a user with instructions as to dosage. The dosage may be dependent upon the age and/or weight of user and is often in confusing and hard to understand terms.

SUMMARY

An embodiment of the present disclosure relates to a closure configured to fit over the opening of a receptacle to form a container. The closure includes an inner dosage cup, and an outer cap portion that receives and retains the inner dosage cup, the outer cap portion being rotatable relative to the inner dosage cup and defining at least one viewing window that allows for visual indication of a level of contents within the inner dosage cup.

Another embodiment of the present disclosure relates to a container. The container includes a receptacle having an opening, and a closure configured to fit over the opening of the receptacle. The closure includes an inner dosage cup, and an outer cap portion that receives and retains the inner dosage cup, the outer cap portion being rotatable relative to the inner dosage cup and defining at least one viewing window that allows for visual indication of a level of contents within the inner dosage cup.

DETAILED DESCRIPTION

Figure 1:
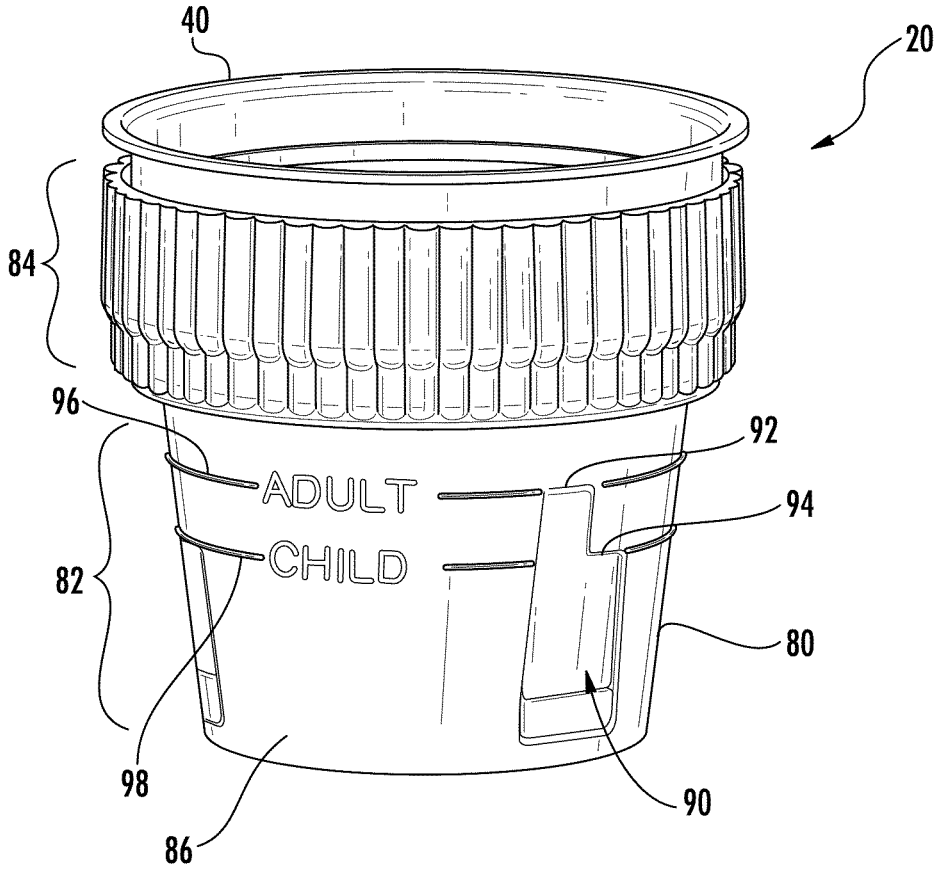
FIG. 1 is a bottom, perspective view of a closure shown according to an exemplary embodiment.

A child resistant closure is provided that is configured to be used with a container suitable for retaining a liquid medicine or any other type of liquid for which it may be desirable to measure a relatively small dose of the liquid for consumption or other use. According to the illustrated embodiment, the closure is shown as a two-piece closure that includes an inner dosage cup and an outer cap portion. Together, the inner dosage cup and the outer cap portion provide a device that functions as both a child resistant closure for selectively sealing or closing off an opening of the container, and also as a device that allows for the selective measurement and/or dispensing of the contents of the container.

The inner dosage cup is retained within the outer cap portion, with the outer cap portion being configured for rotational movement relative to the inner dosage cup. To remove the closure from the container, a force is applied to the outer cap portion in the direction of the inner dosage cup (e.g., an axial and/or radial force, etc.). When a sufficient amount of force is applied, the outer cap portion will engage the inner dosage cup such that the outer cap portion and the inner dosage cup rotate as a unit and disengage the closure from the container. If an insufficient amount of force is applied to the outer cap portion, the outer cap portion will simply rotate relative to the inner dosage cup while the closure remains secured to the container, thereby reducing the likelihood that a child will be able to remove the closure.

With the closure removed, a user can turn the closure over and pour the contents of the container into the inner dosage cup. One or more visual indicators may be provided on the outer cap portion and/or the inner dosage cup to help a user identify when a desired amount of the liquid has been poured into the inner dosage cup. According to an exemplary embodiment, one or more openings are provided in the outer cap portion that allows a user to see the level of liquid within the inner dosage cap. Such openings may be sized and shaped such that the areas of the outer cap portion that define the opening may provide a visual indicator as to the level of the contents within the inner dosage cup. After the liquid is poured into the inner dosage cup, the user can use the inner dosage cup as a conventional cup for delivering the contents. Once the liquid has been removed from the inner dosage cup, the closure can be reapplied to the container.

While the closure is shown and described herein as a closure configured to be used with a container configured to retain a liquid, and more particularly a liquid medicine, the closure may also be suitable for use with a container configured a retain solid matter (e.g., powders, etc.), semi-solid matter or any other type of matter.

Before discussing further the details of the closure and components thereof, it should be noted at the outset that references to "front," "back," "rear," "upper," "lower," "right," and "left" in this description are merely used to identify the various elements as they are oriented in the FIGURES, with "front," "back," and "rear" being relative to the position of the closure when secured to a container. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 2:
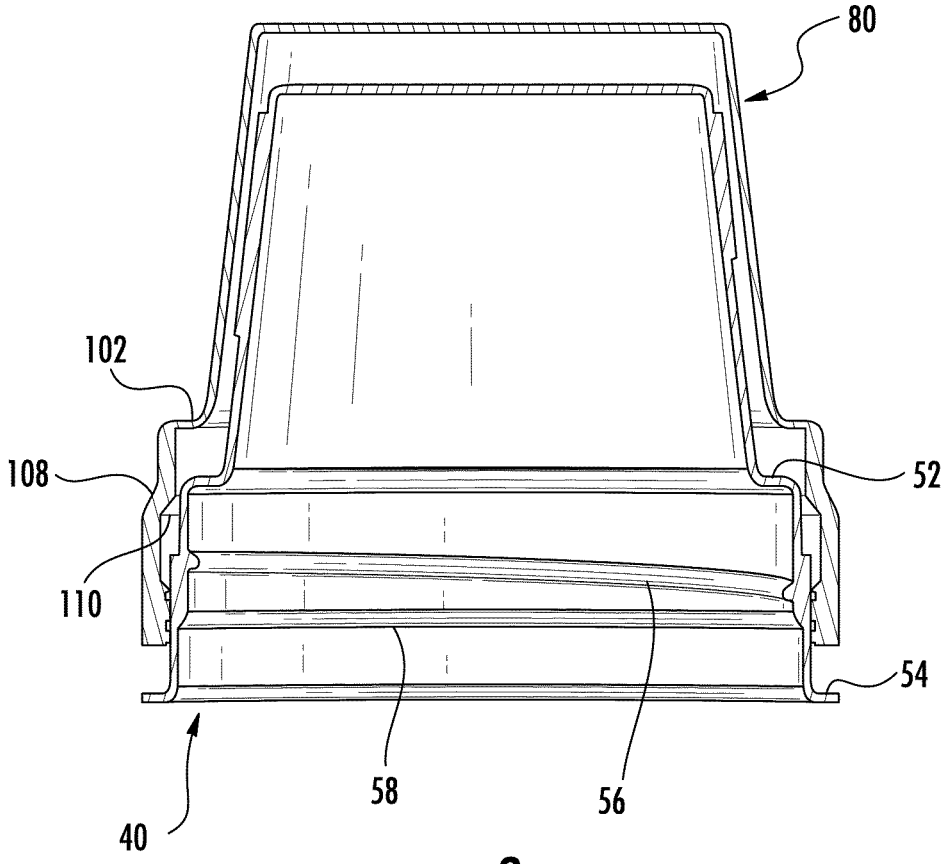
FIG. 2 is a cross sectional view of the closure of FIG. 1.
Figure 3:
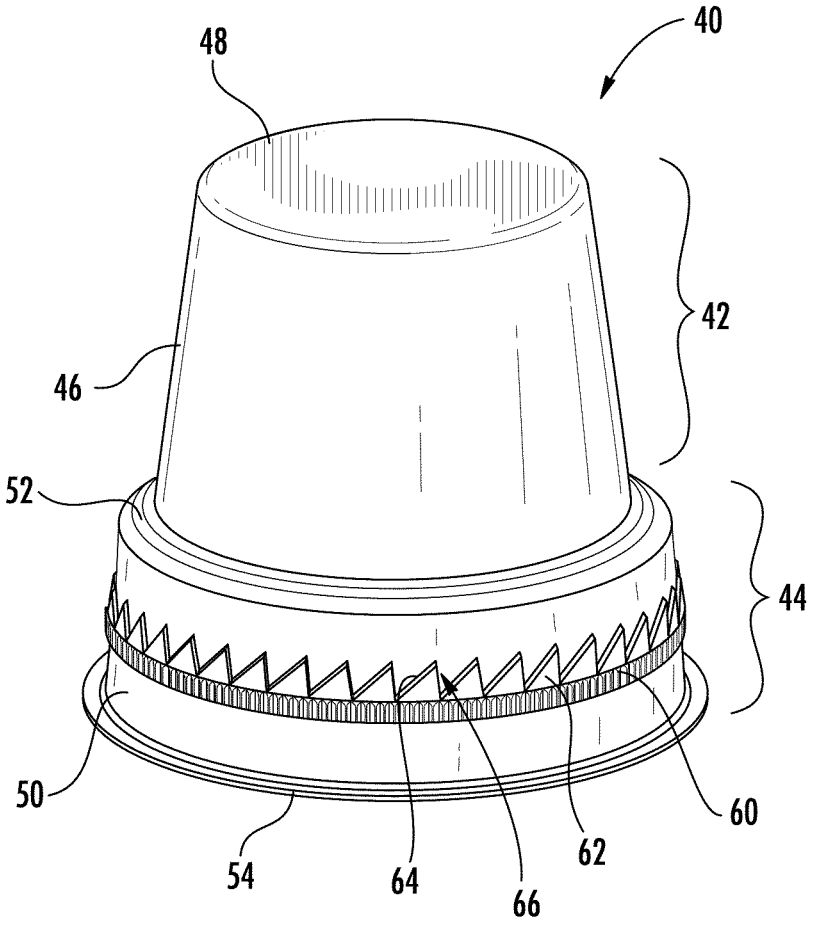
FIG. 3 is a top, perspective view of an inner dosage cup of the closure of FIG. 1 shown according to an exemplary embodiment.

Referring to FIGS. 1 and 2, the closure is shown according to an exemplary embodiment as a closure 20. The closure 20 includes an inner dosage cup 40 and an outer cap portion 80. Referring to FIGS. 2 and 3, the inner dosage cup 40 includes an upper portion, shown as a dosage receiving portion 42, and a lower portion, shown as a coupling portion 44. The dosage receiving portion 42 defines an interior space or receptacle for receiving the liquid medicine from the container and includes a side wall 46 that is generally cylindrical or frusto-conical in shape. The side wall 46 extends continuously in a vertical direction between an end wall 48 of inner dosage cup 40 and coupling portion 44. The side wall 46 may be clear, translucent or opaque and may be formed of a plastic or any other suitable material. Forming the side wall 46 of a clear or translucent material may, as detailed below, allow a user to visually determine a level of a liquid poured into the inner dosage cup 40. According to an exemplary embodiment, the side wall 46 has a truncated conical shape with the side wall 46 being tapered such that the diameter of the side wall 46 near the end wall 48 is smaller than the diameter of side wall 46 near the coupling portion 44. According to the various alternative embodiments, the side wall 46 may have any of a variety of shapes and cross sections.

As detailed below, according to an exemplary embodiment, the outer cap portion 80 is configured to provide a user with a visual indication of the proper dosage within the inner dosage cup 40. With the outer cap portion 80 providing a user with a visual indication of the proper dosage within the inner dosage cup 40, the side wall 46 of the inner dosage cup 40 may be relatively free of any markings, projections or recesses that may otherwise be necessary for this purpose. According to the various alternative embodiments, side wall 46 may include one or more graduation marks for the purpose of indicating a correctly measured amount of liquid in the cup. Such graduation marks could be used to measure in terms of ounces, milliliters, cubic centimeters or other preferred units of measure (e.g., child dosage vs. adult dosage, etc.).

Referring to FIG. 3 in particular, the end wall 48, which is shown as being circular in shape, is orientated substantially perpendicular to a central axis of side wall 46. According to an exemplary embodiment, end wall 48 and side wall 46 are integrally formed as a single unitary body by a molding operation. According to the various alternative embodiments, end wall 48 may have any of a number of shapes and provided at any of a number of orientations relative to the side wall 46. Further, the side wall 46 may be formed separately from the end wall 48 and the two may be coupled together using any known or otherwise suitable technique (e.g., welding, adhesive, etc.).

The coupling portion 44 is sized to fit over and/or around the neck of the container. According to an exemplary embodiment, the coupling portion 44 is in the form of a collar or skirt having a side wall 50 that extends downwardly from the side wall 46. According to an exemplary embodiment, the side wall 50 is concentric with the central axis of the side wall 46 but is displaced or offset radially outwardly from the side wall 46. Defining the transition between the side wall 46 and the side wall 50 is a ledge or shoulder 52. According to an exemplary embodiment, the shoulder 52, like the end wall 48, is substantially perpendicular to a central axis of side wall 46.

The side wall 50 is shown as being substantially cylindrical in shape and having substantially the same cross sectional shape as the side wall 46. The side wall 50 extends in a vertical direction between the shoulder 52 and a bottom edge 54. According to an exemplary embodiment, the bottom edge 54 is in the form of a lip or flange that extends radially outwardly from the side wall 50. The bottom edge 54, like the shoulder 52 and the end wall 48, is substantially perpendicular to a central axis of side wall 46. According to an exemplary embodiment, the bottom edge 54 extends radially outwardly a distance sufficient to at least partially overlap a bottom edge of the outer cap portion 80. According to the embodiment illustrated, the bottom edge 54 has a diameter that is substantially equal to an outer diameter of the outer cap portion 80 at its lowermost edge. Configuring the bottom edge 54 in this manner allows the bottom edge 54 to function as a retaining device that may prevent or limit the axial movement of the inner dosage cup 40 relative to the outer cap portion 80 in a direction towards end wall 48.

According to an exemplary embodiment, the side wall 50 has a truncated conical shape with the side wall 50 being tapered such that the diameter of the side wall 50 near the shoulder 52 is smaller than the diameter of the side wall 50 near the bottom edge 54. According to the various alterative embodiments, the side wall 50 may have any of a variety of shapes and cross sections, including shapes or cross sections that are different than the side wall 46.

Coupling portion 44 includes a first attachment structure or coupling component associated with securing the closure 20 to the container and a second attachment structure or coupling component associated with securing the inner dosage cup 40 to the outer cap portion 80. According to an exemplary embodiment, the first coupling component is provided at an inside surface of the side wall 50, while the second coupling component is provided at an outside surface of the side wall 50.

Figure 4:
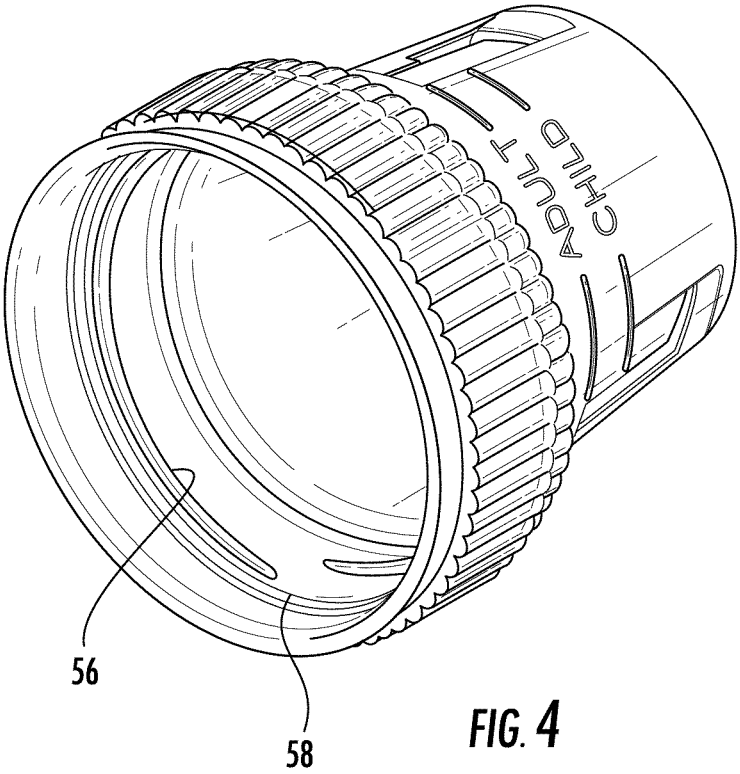
FIG. 4 is a bottom, perspective view of the closure of FIG. 1.

Referring to FIG. 4, the first coupling component of the coupling portion 44 includes one or more threads 56 located on the inside surface of the side wall 50 for engaging a corresponding structure (e.g., thread, etc.) on the neck of the container to removably secure the closure 20 to the open end of the container. According to an exemplary embodiment, the thread 56 is a substantially continuous thread configured for threaded engagement with a conventional threaded portion of the container when the inner dosage cup 40 is rotated in a closing direction (e.g., clockwise). The inner dosage cup 40 is disengageable from the threaded portion of the container when rotated in an opening direction (e.g., counterclockwise). According to the various alternative embodiments, the thread 56 may be discontinuous and formed of one or more segments configured for threaded engagement with a corresponding structure on the container. According to still further alternative embodiments, the first coupling component may be any known or otherwise suitable structure (e.g., press-on rings or snap-fit structure, ribs, etc.) for coupling to the container.

Referring back to FIG. 2, the inside surface of the side wall 50 has a stepped profile that is defined by an inner shoulder 58. According to an exemplary embodiment, the inner shoulder 58 is spaced below the end of the lowermost portion of the thread 56. The profile of the inner surface of the side wall 50 tapers vertically in a substantially continuous manner (e.g., linear, etc.) both above and below the inner shoulder 58. According to the various alternative embodiments, the profile of the inner surface of the side wall 50 may have any of a variety of cross sectional profiles above and below the inner shoulder 58. As shown in FIG. 2, the thickness of the side wall 50 is thicker in at least an area immediately above the inner shoulder 58 than below the inner shoulder 58. This reduction in thickness is intended to reduce the amount of material (e.g., plastic, etc.) that is needed to form the inner dosage cup 40 while still providing the necessary material for forming one or more of the second coupling components. According to the various alternative embodiments, the inner shoulder 58 may be eliminated and the inside surface of the side wall 50 may be substantially continuous, except for the thread 56 or any other coupling component provided thereon.

Referring again to FIG. 3, the second coupling component of the coupling portion 44 includes a projection (e.g., protrusion, ring, etc.), shown as a rib 60, and one or more angular projections, shown as first toothings 62, extending upward from the rib 60. The rib 60 assists in retaining the inner dosage cup 40 at the desired axial orientation relative to the outer cap portion 80, while the first toothings 62 facilitate the selective engagement of the inner dosage cup 40 with the outer cap portion 80 such that the outer cap portion 80 and the inner dosage cup 40 can rotate as a unit and disengage the closure 20 from the container. According to the embodiment illustrated, the rib 60 and the first toothings 62 are centrally located in a vertical direction along the side wall 50.

According to an exemplary embodiment, the rib 60 is an annular member that extends outwardly from the outer surface of the side wall 50 and continuously around the periphery of the side wall 50. The cross sectional profile of the rib 60 is shown as being substantially rectangular in shape and has a bottom edge that is located at substantially the same vertical height as the inner shoulder 58. The rib 60 extends radially outwardly a distance sufficient to at least partially engage a corresponding structure (e.g., a projection, groove, etc.) provided on the outer cap portion 80. Configuring the rib 60 in this manner allows the rib 60 to function as a retaining device that may prevent or limit the axial movement the inner dosage cup 40 relative to the outer cap portion 80 in a direction opposite the end wall 48. According to the various alternative embodiments, the rib 60 may be provided intermittently around the periphery of the side wall 50 as one or more segments and/or may have any of a number of cross sectional profiles.

Still referring to FIG. 3, the first toothings 62 are shown according to an exemplary embodiment. According to the embodiment illustrated, the first toothings 62 are triangular members that form a saw tooth arrangement around the entire periphery of the side wall 50. The first toothings 62 extend upwardly from the rib 60 and outwardly relative to a portion of the side wall 50 provided above the first toothings 62. According to an exemplary embodiment, an outer surface of the first toothings 62 is substantially coplanar with a portion of the outside surface of the side wall 50 that is below the rib 60. In such an embodiment, the first toothings 62 do not extend outward from the outside surface of the side wall 50 as far as the ribs 60. As shown, each of the first toothings 62 have an angled or sloped first surface 64 and a substantially vertical second surface 66. According to an exemplary embodiment, the first surface 64 and the second surface 66 define an angle therebetween ranging from approximately 30 degrees to approximately 60 degrees. According to the embodiment illustrated, the angle between the first surface 64 and the second surface 66 is approximately 45 degrees and the total number of first toothings 62 extending around the side wall 50 is forty (40). According to the various alternative embodiments, the first toothings 62 may have any of a variety of shapes, may be provided at any of a number of angles and/or may include more or less toothings than the exemplary embodiment detailed above.

Referring back to FIG. 1, the outer cap portion 80 is shown according to an exemplary embodiment. The outer cap portion 80 is shown as being somewhat similar in shape to the inner dosage cup 40 and including an upper portion 82 and a lower portion 84. The upper portion 82 and the lower portion 84 cooperate to define an interior space configured to receive the inner dosage cup 40, with the upper portion 82 being configured to receive the dosage receiving portion 42 of the inner dosage cup 40. According to an exemplary embodiment, the upper portion 82 includes a side wall 86 that is generally cylindrical in shape. The side wall 86 extends continuously in a vertical direction between an end wall 88 of the outer cap portion 80 and the lower portion 84. According to an exemplary embodiment, the side wall 86 has a truncated conical shape with the side wall 86 being tapered such that the diameter of the side wall 86 near the end wall 88 is smaller than the diameter of side wall 86 near the lower portion 84. According to the various alterative embodiments, the side wall 86 may have any of a variety of shapes and cross sections.

The side wall 86 includes one or more features intended to assist a user in determining whether the desired amount of liquid is within the inner dosage cup 40. According to an exemplary embodiment, the side wall 86 defines one or more openings, shown as windows 90, that extend through the side wall 86. The windows 90, which are shown as including three separate openings that are equally spaced around the periphery of the side wall 86, allow a user to see the inner dosage cup 40 through the side wall 86. By forming at least a corresponding portion of the inner dosage cup 40 of a clear or translucent material, the windows 90 will also allow the user to see the contents of the inner dosage cup 40 and/or the level the of the contents within the inner dosage cup 40.

Any number of the windows 90 may be provided in the side wall 86. Further, the windows 90 may have any of a number of shapes (e.g., rectangular, circular, triangular, etc.). Further still, if more than one window 90 is provided, the windows 90 may have the same or different shapes. According to an exemplary embodiment, the shape of the windows 90 is selected such that the shape itself can be used by the user as a reference or a measuring device for determining whether a proper amount of the liquid has been added to the inner dosage cup 40. According to the embodiment illustrated, the windows 90 are at least partially defined by a first horizontal edge 92 and a second horizontal edge 94. The height of the first horizontal edge 92 relative to the end wall 88 is associated with a first measurement and is provided at a different height than the second horizontal edge 94. The second horizontal edge 94 is associated with a second measurement. For example, the first horizontal edge 92 may represent a level at which liquid should be added to the inner dosage cup 40 for an adult, while the second horizontal edge 94 may represent a level at which liquid should be added to the inner dosage cup 40 for a child.

To further assist a user in determining whether the proper dosage of the liquid has been added to the inner dosage cup 40, the side wall 86 includes one or more graduation marks for this purpose. Such graduation marks could be used to measure in terms of ounces, milliliters, cubic centimeters or other preferred units of measure (e.g., child dosage vs. adult dosage, etc.). According to the embodiment illustrated, the side wall 86 includes a first mark 96 and a second mark 98. The first mark 96 and the second mark 98 each include one or more horizontal line segments extending around the side wall 86 and indicia (e.g., text, numbers, image, etc.) intended to inform the user of the meaning of the horizontal line segment. As shown, the first mark 96 includes the text "ADULT" and is intended to represent the approximate dosage for a typical adult. The horizontal line segment of the first mark 96 is substantially coplanar with the first horizontal edge 92 of the window 90. Similarly, the second mark 98 includes the text "CHILD" and is intended to represent the approximate dosage for a typical child. The horizontal line segment of the first mark 96 is substantially coplanar with the second horizontal edge 94 of the window 90. According to the various alternative embodiments, any number of marks can be provided along the side wall 86 to assist a user in determining whether the proper dosage of the liquid has been added to the inner dosage cup 40.

Figure 5:
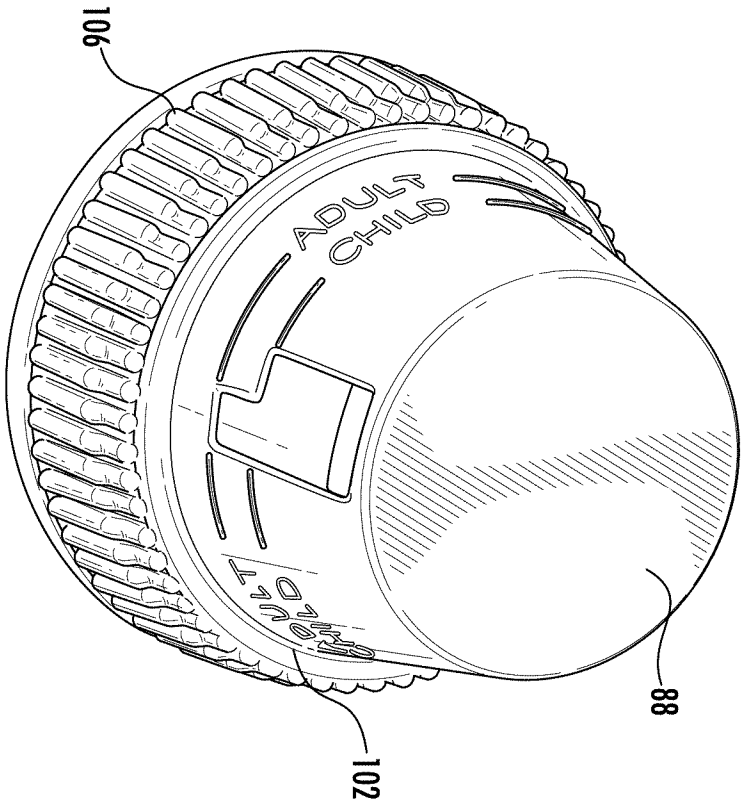
FIG. 5 is another top, perspective view of the closure of FIG. 1.

Referring to FIG. 5, the end wall 88, which is shown as being circular in shape, is oriented substantially perpendicular to a central axis of side wall 86, which is configured to be substantially concentric with the side wall 46 when the closure 20 is assembled. According to an exemplary embodiment, end wall 88 and side wall 86 are integrally formed as a single unitary body by a molding operation. According to the various alternative embodiments, end wall 88 may have any of a number of shapes and provided at any of a number of orientations relative to the side wall 86. Further, the side wall 86 may be formed separately from the end wall 88 and the two may be coupled together using any known or otherwise suitable technique (e.g., welding, adhesive, etc.).

Referring back to FIG. 1, the lower portion 84 is sized to fit over and/or around the coupling portion 44 of the inner dosage cup 40. According to an exemplary embodiment, the lower portion 84 is in the form of a collar or skirt having a side wall 100 that extends downwardly from the side wall 86. According to an exemplary embodiment, the side wall 100 is concentric with the central axis of the side wall 86 but is displaced or offset radially outwardly from the side wall 86. Defining the transition between the side wall 86 and the side wall 100 is a first ledge or shoulder 102. According to an exemplary embodiment, the first shoulder 102, like the end wall 88, is substantially perpendicular to a central axis of side wall 86.

The side wall 100 is shown as being substantially cylindrical in shape and having substantially the same cross sectional shape as the side wall 86. The side wall 100 extends in a vertical direction between the first shoulder 102 and a bottom edge 104. According to an exemplary embodiment, the side wall 100 has a truncated conical shape with the side wall 100 being tapered such that the diameter of the side wall 100 near the first shoulder 102 is smaller than the diameter of the side wall 100 near the bottom edge 104. According to the various alterative embodiments, the side wall 100 may have any of a variety of shapes and cross sections, including shapes or cross sections that are different than the side wall 86.

According to an exemplary embodiment, an outer surface of the side wall 100 includes a gripping surface 106 which is provided to allow the closure 20, and particularly the outer cap portion 80, to be more easily grasped and rotated relative to the inner dosage cup 40 and/or container. According to the embodiment illustrated, the gripping surface 106 includes a series of vertical ribs or corrugations extending around the entire periphery of the side wall 100. According to the various alternative embodiments, the outer surface of the side wall 100 may have a different structure that facilitates gripping of the outer cap portion 80 (e.g., one or more substantially flat sections, etc.) or may not include a gripping structure.

Figure 6:
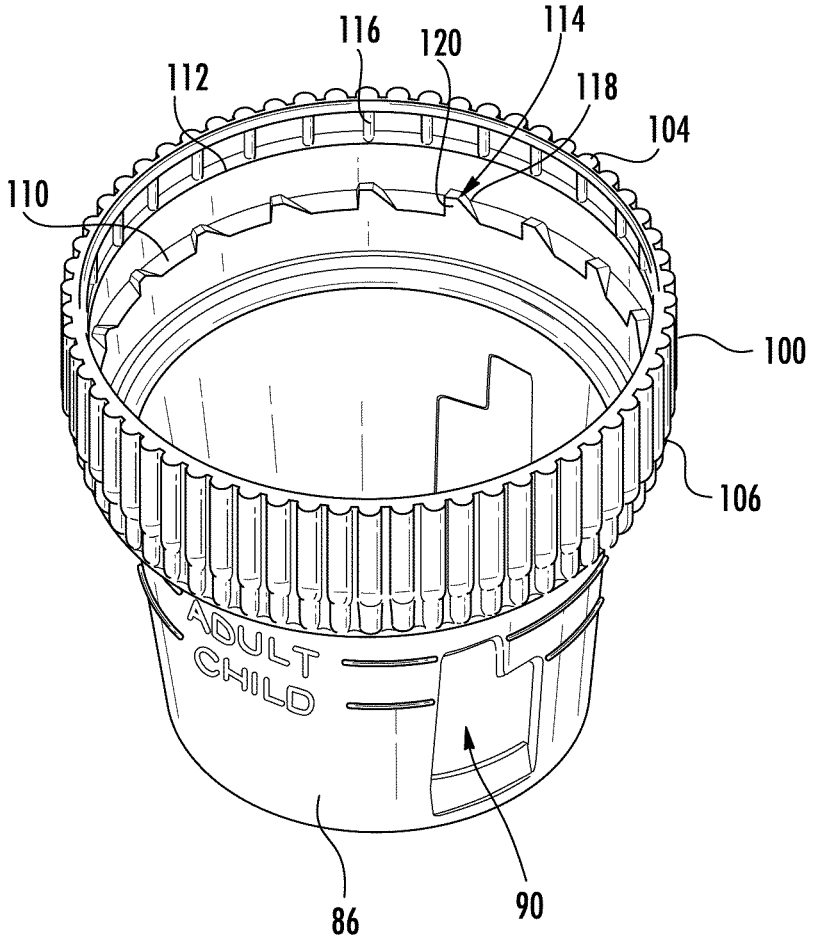
FIG. 6 is a bottom, perspective view of an outer cap portion of the closure of FIG. 1 shown according to an exemplary embodiment.
Figure 7:
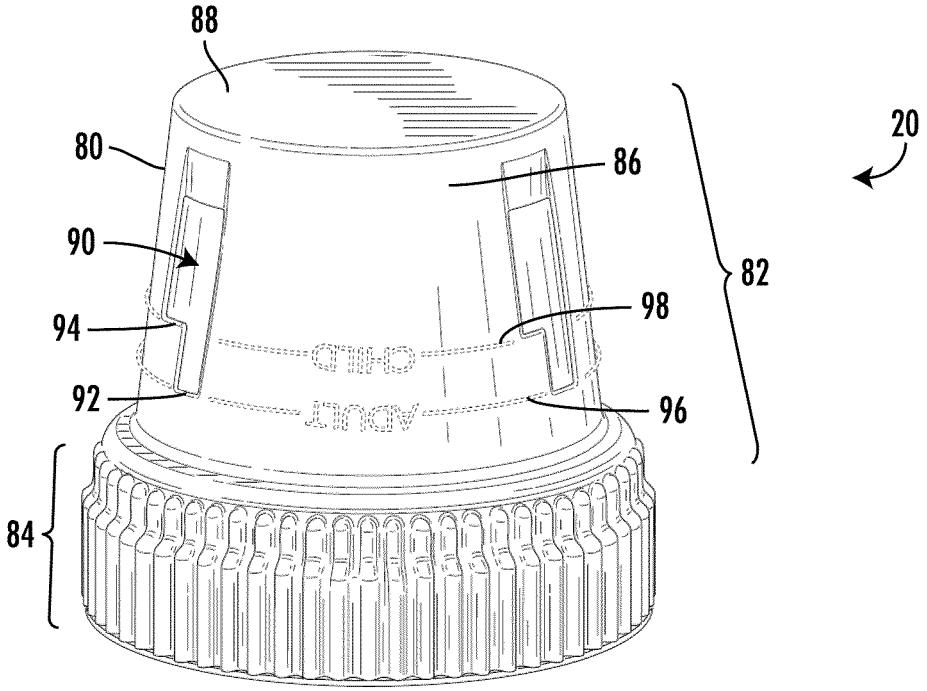
FIG. 7 is a top perspective view of the closure of FIG. 1.
Figure 8:
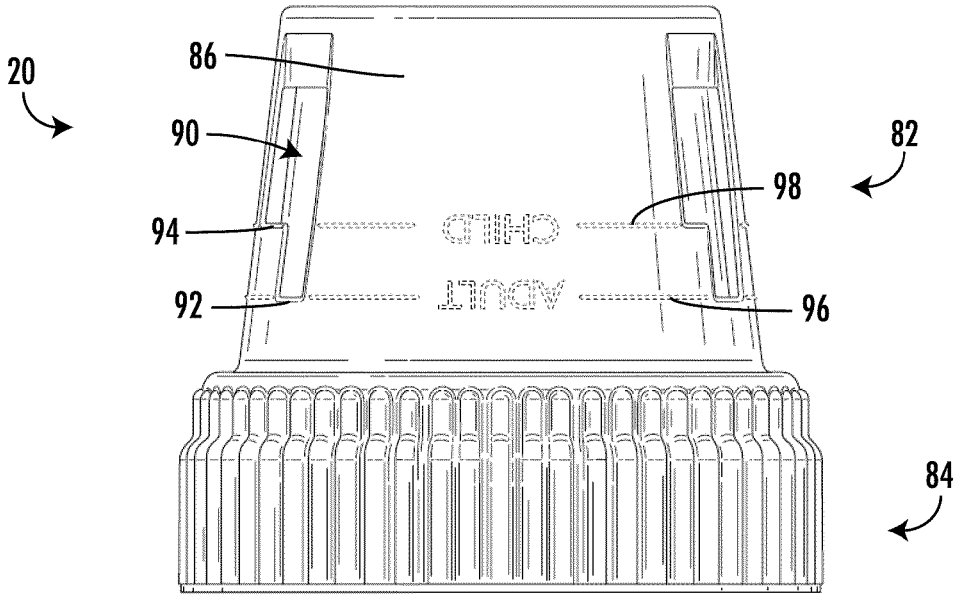
FIG. 8 is a first elevation view of the closure of FIG. 1.
Figure 9:
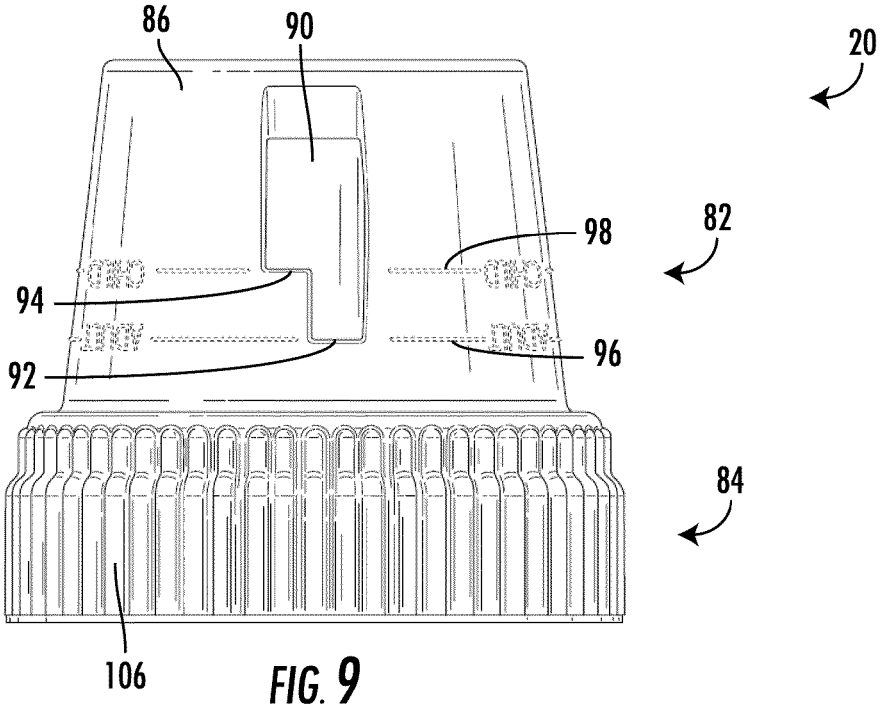
FIG. 9 is a second elevation view of the closure of FIG. 1.
Figure 10:
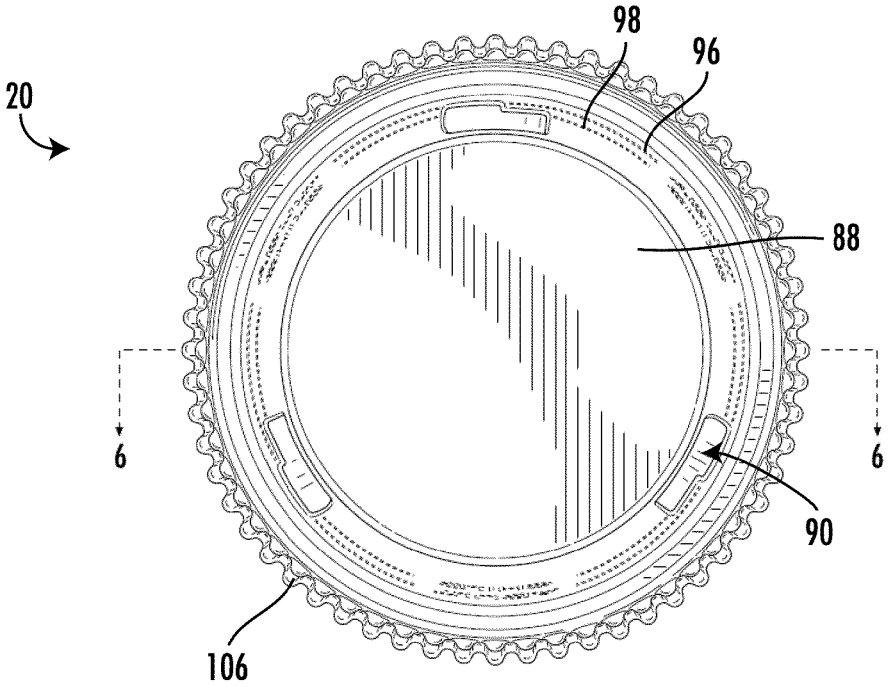
FIG. 10 is a top plan view of the closure of FIG. 1.
Figure 11:
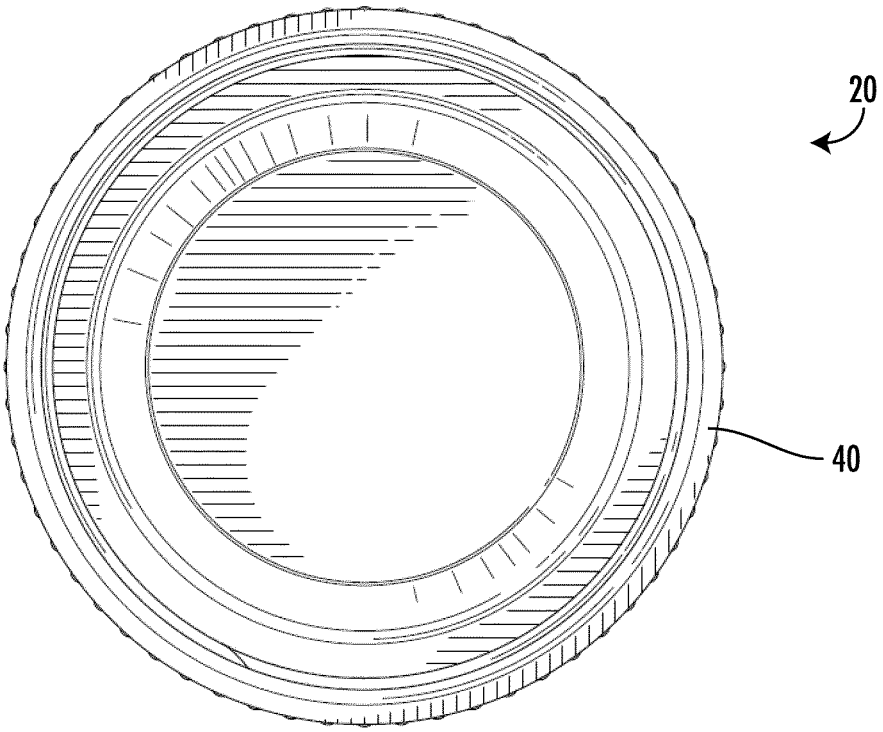
FIG. 11 is a bottom plan view of the closure of FIG. 1.
Figure 12:
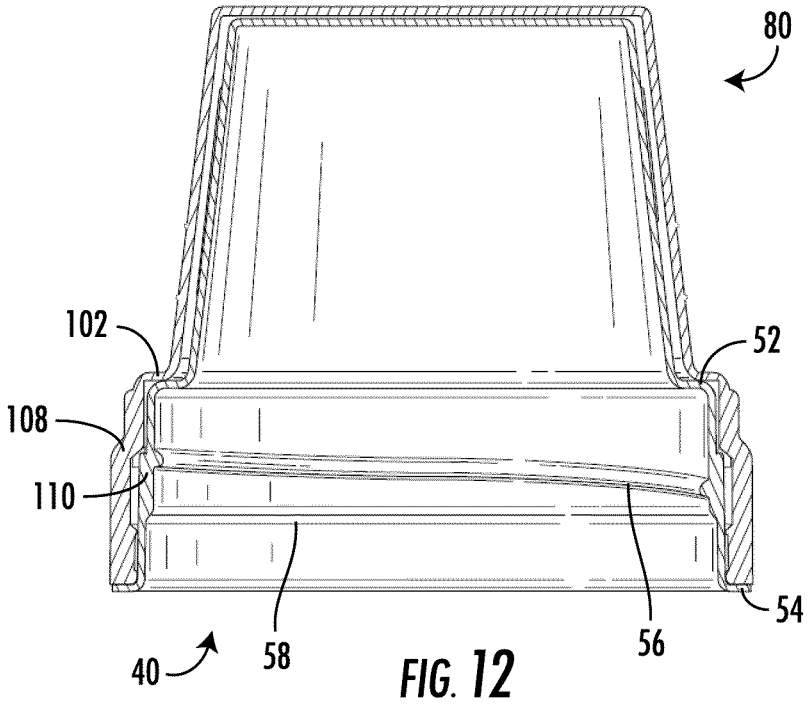
FIG. 12 is a cross sectional view of the closure of FIG. 1 taken along a line 6-6 in FIG. 10.

Referring to FIGS. 1 and 6, the side wall 100 has a stepped profile that is present on both the outer surface and an inner surface of the side wall 100. The stepped profile is defined by a second shoulder 108 on the outer surface of the side wall 100 and a corresponding inner shoulder 110 on the inner surface of the side wall 100. According to an exemplary embodiment, the orientation of the second shoulder 108 and the inner shoulder 110 relative to the remaining portions of the side wall 100 is provided at an angle that is less than 90 degrees. For example, the second shoulder 108 and the inner shoulder 110 may be provided at an angle relative to the remaining portions of the side wall 100 that is between approximately 60 degrees and approximately 30 degrees relative to the remaining portions of the side wall 100. The profile of the side wall 100 tapers vertically in a substantially continuous manner (e.g., linear, etc.) both above and below the second shoulder 108 and the inner shoulder 110. According to the various alternative embodiments, the profile of the side wall 100 may have any of a variety of cross sectional profiles above and below the second shoulder 108 and the inner shoulder 110.

With regard to the outer surface of side wall 100, the gripping surface 106 is shown as extending vertically along the side wall 100 both above and below the second shoulder 108. According to the various alternative embodiments, the gripping surface 106 may be selectively provided in only those areas that are above or below the second shoulder 108. Referring to FIG. 6 in particular, the inner surface of the side wall 100 is shown according to an exemplary embodiment. The inner surface of the side wall 100 includes an attachment structure or coupling component associated with securing the outer cap portion 80 to the inner dosage cup 40. According to an exemplary embodiment, the coupling component includes a projection (e.g., protrusion, ring, etc.), shown as a rib 112, and one or more angular projections, shown as second toothings 114. The rib 112 is configured to interact with the rib 60 provided on the inner dosage cup 40 to assist in retaining the inner dosage cup 40 at the desired axial orientation relative to the outer cap portion 80. The second toothings 114 are configured to interact with the first toothings 62 to facilitate the selective engagement of the inner dosage cup 40 with the outer cap portion 80 such that the outer cap portion 80 and the inner dosage cup 40 can rotate as a unit and disengage the closure 20 from the container.

According to an exemplary embodiment, the rib 112 is an annular member that extends outwardly from the inner surface of the side wall 100 and continuously around the periphery of the side wall 100. The cross sectional profile of the rib 112 is shown as being substantially rectangular in shape, but according to the various alternative embodiments, the rib 112 may be provided intermittently around the periphery of the side wall 100 as one or more segments and/or may have any of a number of cross sectional profiles. The rib 112 is provided near, but is spaced apart from, the bottom edge 104. According to the embodiment illustrated, a plurality of support members 116 are provided to support the rib 112. The support members 116 are shown as extending in a vertical direction around the periphery of the side wall 100 and between the bottom edge 104 and the rib 112. The rib 112 extends radially outwardly at a distance sufficient to at least partially engage the rib 60 provided on the inner dosage cup 40. According to an exemplary embodiment, the rib 112 is configured to engage the rib 60 in a snap-fit manner. Configuring the rib 112 in this manner allows the rib 112 to function as a retaining device that may prevent or limit the axial movement of the inner dosage cup 40 relative to the outer cap portion 80 in a direction opposite the end wall 88.

Still referring to FIG. 6, the second toothings 114 are shown according to an exemplary embodiment. The second toothings 114 are spaced apart from each other and extend downward from the inner shoulder 110. According to an exemplary embodiment, the second toothings 114 extend outward from an inner portion of the side wall 100 that is below the inner shoulder 110 a distance such that the second toothings 114 are substantially coplanar with an inner portion of the side wall 100 that is above the inner shoulder 110. Configuring the second toothings 114 in this manner allows for the formation of the stepped profile of the side wall 100. The stepped profile of the side wall 100 requires less material (e.g., plastic, etc.) to form the outer cap portion 80 than if the stepped profile was not provided because the area above the second shoulder 108 is able to be thinner. According to the various alternative embodiments, the stepped profile may be eliminated for one or more of the outer and inner surfaces of the side wall 100. If eliminated, such surfaces may be substantially continuous or provided with any of a number of suitable profiles.

According to an exemplary embodiment, the second toothings 114 are truncated triangular members that extend from the inner shoulder 110. As shown, each of the second toothings 114 have an angled or sloped first surface 118 and a substantially vertical second surface 120. The angle of the first surface 118 compliments the angle of the first surface 64 of the toothings 62. According to an exemplary embodiment, the first surface 118 and the second surface 120 define an angle therebetween ranging from approximately 30 degrees to approximately 60 degrees. According to the embodiment illustrated, the angle between the first surface 118 and the second surface 120 is approximately 45 degrees and the total number of second toothings 114 extending around the side wall 50 is twenty (20). Thus, the ratio of the first toothings 62 to the second toothings 114 is shown as being 2:1, but alternatively, may be any ratio such as 1:1, 3:1 etc. According to the various alternative embodiments, the second toothings 114 may have any of a variety of shapes, may be provided at any of a number of angles and/or may include more or less toothings than the exemplary embodiment detailed above.

The closure 20 is configured to be assembled by inserting the inner dosage cup 40 into the outer cap portion 80. The inner dosage cup 40 can be inserted into the outer cap portion 80 by axially aligning the two components and moving at least one of the components toward the other component. As the inner dosage cup 40 is being inserted into the outer cap portion 80, the rib 60 on the outer surface of the inner dosage cup 40 is configured to engage and snap over the rib 112 on the inner surface of the outer cap portion 80 by having the side wall 50 flex inwardly. Once the rib 60 has snapped over the rib 112, the side wall 50 returns to its previous shape and the engagement of the rib 60 with the rib 112 limits and/or prevents the axial movement of the inner dosage cup 40 relative to the outer cap portion 80 in a direction opposite the direction of insertion. According to an exemplary embodiment, such insertion is intended to be done by the manufacturer and the engagement between the rib 60 and the rib 112 is not intended to be reversed by a user.

With the inner dosage cup 40 inserted into the outer cap portion 80 and retained relative thereto, the outer cap portion 80 is configured for rotational movement relative to the inner dosage cup 40. To secure the closure 20 to the container, the thread 56 of the inner dosage cup 40 is aligned with a corresponding structure at an open end of the container. A rotative force is then used to turn the outer cap portion 80 in a closing direction (e.g., clockwise, etc.) relative to the container. As the outer cap portion 80 is turned in the closing direction, the second toothings 114 associated with the outer cap portion 80 will engage the first toothings 62 associated with the inner dosage cup 40 such that the inner dosage cup 40 will rotate with the outer cap portion 80. Specifically, the second surface 120 of the second toothings 114 will engage the second surface 66 of the first toothings 62. Together the outer cap portion 80 and the inner dosage cup 40 can be rotated until the closure 20 is secured to the container.

After the closure 20 is secured to the container, when the outer cap portion 80 is rotated in an opening direction (e.g., counterclockwise, etc.), the second toothings 114 associated with the outer cap portion 80 will ratchet or ride up over the first toothings 62 associated with the inner dosage cup 40, thereby preventing rotation of the inner dosage cup 40. Specifically, the first surface 118 of the second toothings 114 will engage the first surface 64 of the first toothings 62, but will ride up over the first toothings 62. Such a configuration is intended to prevent a child from removing the closure 20 from the container.

In order to open the sealed container, the user must apply both a rotative force and a second force to the outer cap portion 80. According to an exemplary embodiment, the second force is axial force in a downward direction. In such an embodiment, it is the axial force that prevents the second toothings 114 of the outer cap portion 80 from ratcheting or riding up over the first toothings 62 of the inner dosage cup 40. Thus, when the outer cap portion 80 is rotated in the opening direction, with the use of both a rotational and axial force, the second toothings 114 engage the first toothings 62 such that the outer cap portion 80 and the inner dosage cup 40 rotate together as a unit. The continual movement of the outer cap portion 80 and the inner dosage cup 40 in this manner will disengage the thread 56 from the container and allow the closure to be removed.

With the closure 20 removed, the user can turn the closure 20 over and pour the contents of the container into the inner dosage cup 40. According to the embodiment illustrated, the user may utilize the window 90, the first horizontal edge 92, the second horizontal edge 94, the first mark 96 and/or the second mark 98 to assist with identifying when a desired amount of the liquid has been poured into the inner dosage cup 40. When the desired amount of liquid has been poured into the inner dosage cup 40, the user can use the closure 20 as a cup and consume the contents directly therefrom. Once the contents of the inner dosage cup 40 have been removed, the closure can be reattached to the container.

It is also important to note that the construction and arrangement of the elements of the closure 20 as shown in the exemplary embodiment is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements and those shown a multiple parts may be integrally formed. Accordingly, all such modifications are intended to be included within the scope of the present inventions. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

What is claimed is:

1. A closure configured to fit over the opening of a receptacle to form a container, the closure comprising:

an inner dosage cup; and an outer cap portion that receives and retains the inner dosage cup, the outer cap portion being rotatable relative to the inner dosage cup and defining at least one viewing window that allows for visual indication of a level of contents within the inner dosage cup, wherein the at least one viewing window extends through a side wall of the outer cap portion such that the inner dosage cup is visible through the side wall when the inner dosage cup is retained within the outer cap portion, wherein the at least one viewing window is at least partially defined by a first horizontal edge having a first height relative to an end wall of the outer cap portion and a second horizontal edge having a second height relative to the end wall, wherein the first height is associated with a first dosage amount for the contents within the inner dosage cup and the second height is associated with a second dosage amount for the contents within the inner dosage cup, and wherein the first height is greater than the second height.

2. The closure of claim 1, wherein the inner dosage cup comprises:

a body portion defining an area configured to receive the contents of the container; and a skirt downwardly extending from the body portion, the skirt being radially offset in an outward direction from the body portion.

3. The closure of claim 2, wherein an inner surface of the skirt includes a first coupling component configured to releasably secure the closure to the receptacle.

4. The closure of claim 3, wherein the first coupling component is a thread configured to threadably engage a corresponding structure provided on the receptacle.

5. The closure of claim 2, wherein an outer surface of the skirt includes a second coupling component comprising a structure that facilitates selective engagement of the inner dosage cup with the outer cap portion such that the outer cap portion rotates with the inner dosage cup when a rotative force and a second force is applied to the outer cap portion but rotates relative to the inner dosage cup when only the rotative force is applied to the outer cap.

6. The closure of claim 5, wherein the structure comprises at least one toothing configured to selectively engage a corresponding structure provided on the outer cap portion.

7. The closure of claim 5, wherein the second coupling component further comprises at least one of a projection and a recess that is configured to interact with a corresponding structure on the outer cap portion to limit the axial movement of the inner dosage cup relative to the outer cap portion.

8. The closure of claim 7, wherein the at least one of a projection and a recess comprises an annular rib extending continuously around a periphery of the skirt and configured to interact with a projection provided on the outer cap portion.

9. The closure of claim 8, wherein the annular rib is immediately below the structure that facilitates selective engagement of the inner dosage cup with the outer cap portion such that the outer cap portion rotates with the inner dosage cup when a rotative force and a second force is applied to the outer cap portion but rotates relative to the inner dosage cup when only the rotative force is applied to the outer cap.

10. The closure of claim 2, wherein the skirt includes a bottom edge defined by an outwardly extending flange that is configured to engage the outer cap portion to restrict axial movement of the inner dosage cup relative to the outer cap portion.

11. The closure of claim 1, wherein the outer cap portion comprises:

a body portion that defines the at least one viewing window; and a skirt downwardly extending from the body portion, the skirt being radially offset in an outward direction from the body portion.

12. The closure of claim 11, wherein an inner surface of the skirt includes a coupling component comprising a structure that facilitates selective engagement of the inner dosage cup with the outer cap portion such that the outer cap portion rotates with the inner dosage cup when a rotative force and a second force is applied to the outer cap portion but rotates relative to the inner dosage cup when only the rotative force is applied to the outer cap.

13. The closure of claim 12, wherein the structure comprises at least one toothing configured to selectively engage a corresponding structure provided on the inner dosage cup.

14. The closure of claim 12, wherein the second coupling component further comprises at least one of a projection and a recess that is configured to interact with a corresponding structure on the inner dosage cup to limit the axial movement of the inner dosage cup relative to the outer cap portion.

15. The closure of claim 14, wherein the at least one of a projection and a recess comprises an annular rib extending continuously around a periphery of the skirt and configured to interact with a projection provided on the inner dosage cup.

16. The closure of claim 11, wherein the skirt has a stepped profile such that a lower portion of the skirt radially offset in an outward direction from an upper portion of the skirt.

17. The closure of claim 16, wherein the stepped profile is defined by an outer shoulder and an inner shoulder, the inner shoulder providing a surface that supports a structure that facilitates selective engagement of the inner dosage cup with the outer cap portion such that the outer cap portion rotates with the inner dosage cup when a rotative force and a second force is applied to the outer cap portion but rotates relative to the inner dosage cup when only the rotative force is applied to the outer cap, the structure including at least one toothing configured to selectively engage a corresponding structure provided on the inner dosage cup.

18. The closure of claim 16, wherein an outer surface of the skirt includes a gripping surface that extends between the lower portion and the upper portion.

19. The closure of claim 1, wherein the at least one viewing window is configured to provide at least one reference for identifying an appropriate dosage for one or more users.

20. A container comprising:

a receptacle having an opening; and a closure configured to fit over the opening of the receptacle, the closure comprising:

an inner dosage cup comprising a first annular rib; and an outer cap portion that receives and retains the inner dosage cup, the outer cap portion being rotatable relative to the inner dosage cup and comprising a second annular rib extending continuously around a periphery of the outer cap portion and being configured to interact with the first annular rib to retain the inner dosage cup in a desired axial orientation relative to the outer cap portion and a plurality of vertical support members extending between a bottom edge of the outer cap portion and the second annular rib and configured to support the second annular rib, the outer cap portion defining at least one viewing window that allows for visual indication of a level of contents within the inner dosage cup.

* * * * *